US011125231B2

(12) United States Patent
Shimozono et al.

(10) Patent No.: US 11,125,231 B2
(45) Date of Patent: Sep. 21, 2021

(54) COMPRESSOR FOR REFRIGERATING MACHINE

(71) Applicant: DAIKIN INDUSTRIES, LTD., Osaka (JP)

(72) Inventors: Naoki Shimozono, Osaka (JP); Mikio Kajiwara, Osaka (JP); Tomomi Yokoyama, Osaka (JP); Kouji Kojima, Osaka (JP); Tsuyoshi Fukunaga, Osaka (JP); Mahoba Ogawa, Osaka (JP); Yasuhiro Yamamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/321,439

(22) PCT Filed: Jul. 26, 2017

(86) PCT No.: PCT/JP2017/027117
§ 371 (c)(1),
(2) Date: Jan. 28, 2019

(87) PCT Pub. No.: WO2018/021441
PCT Pub. Date: Feb. 1, 2018

(65) Prior Publication Data

US 2019/0338774 A1 Nov. 7, 2019

(30) Foreign Application Priority Data

Jul. 29, 2016 (JP) ..... JP2016-150615

(51) Int. Cl.
*F04C 18/02* (2006.01)
*F04B 39/00* (2006.01)
(Continued)

(52) U.S. Cl.
CPC ..... *F04C 18/0215* (2013.01); *C23C 4/06* (2013.01); *F04B 39/00* (2013.01);
(Continued)

(58) Field of Classification Search
CPC ..... F04C 18/0215; F04C 2240/30; F04C 2230/91; F04C 23/008; F04C 29/00;
(Continued)

(56) References Cited

U.S. PATENT DOCUMENTS 2,093,639 A * 9/1937 Markwick ..... G01B 3/30 33/501.08
3,092,306 A * 6/1963 Eder ..... C23C 4/08 415/173.4

(Continued)

FOREIGN PATENT DOCUMENTS

JP 2000303188 A * 10/2000
JP 2002-303272 A 10/2002

OTHER PUBLICATIONS

International Preliminary Report of corresponding PCT Application No. PCT/JP2017/027117 dated Feb. 7, 2019.

(Continued)

*Primary Examiner* — Len Tran
*Assistant Examiner* — Kirstin U Oswald
(74) *Attorney, Agent, or Firm* — Global IP Counselors, LLP

(57) ABSTRACT

A compressor includes a casing and a metallic coating. The casing includes a low-pressure casing part covering a low-pressure space and a high-pressure casing part covering a high-pressure space. The metallic coating is formed at least on a part of an outer surface of the casing. The metallic coating includes a low-pressure part coating formed in the low-pressure casing part, a high-pressure part coating formed in the high-pressure casing part, and a welded part coating formed in a welded part. At least either the average thickness of the low-pressure part coating or the average thickness of the welded part coating is greater than the average thickness of the high-pressure part coating.

20 Claims, 10 Drawing Sheets

(51) Int. Cl.

| | |
|---|---|
| ***F04B 39/12*** | (2006.01) |
| ***F25B 1/04*** | (2006.01) |
| ***F25B 47/00*** | (2006.01) |
| ***F25D 11/00*** | (2006.01) |
| ***C23C 4/06*** | (2016.01) |

(52) U.S. Cl.
CPC ..... *F04B 39/0094* (2013.01); *F04B 39/12* (2013.01); *F25B 1/04* (2013.01); *F25B 47/00* (2013.01); *F25D 11/003* (2013.01); *F04C 2230/91* (2013.01); *F04C 2240/30* (2013.01); *F25B 2347/00* (2013.01)

(58) Field of Classification Search
CPC .. F04C 2230/231; F25D 11/003; F25B 47/00; F25B 1/04; F25B 2347/00; F04B 39/12; F04B 39/0094; F04B 39/00; C23C 4/06; F01C 21/10; B32B 3/00; B32B 3/263
USPC ..... 62/498
See application file for complete search history.

(56) References Cited

U.S. PATENT DOCUMENTS 3,203,404 A * 8/1965 Miller ..... F24H 9/0036 122/236
3,971,633 A * 7/1976 Wolfla ..... C23C 4/02 428/552
4,815,947 A * 3/1989 Okoma ..... F04C 23/008 417/410.3
5,017,740 A * 5/1991 Honkomp ..... H01B 17/305 174/138 F
5,439,348 A * 8/1995 Hughes ..... F01D 11/122 29/889.2
5,582,415 A * 12/1996 Yoshida ..... F16J 15/0825 277/592
5,714,202 A * 2/1998 Lemelson ..... C23C 4/02 427/249.14
5,941,160 A * 8/1999 Kato ..... B05C 1/02 92/155
6,176,298 B1 * 1/2001 Watters ..... B22D 11/059 164/418
8,911,878 B2 * 12/2014 Tomantschger ..... B32B 1/08 428/626
9,567,664 B2 * 2/2017 Bolz ..... C23C 28/042
2003/0194576 A1 * 10/2003 Cooper ..... F04B 39/121 428/626
2010/0064702 A1 * 3/2010 Lifson ..... B60H 1/3223 62/115
2010/0086426 A1 * 4/2010 Ohkawa ..... F16C 33/201 418/55.1
2010/0284844 A1 * 11/2010 Yamaji ..... F04C 18/0246 418/55.1

OTHER PUBLICATIONS

European Search Report of corresponding EP Application No. 17 83,4443,8 dated Nov. 13, 2019.
International Search Report of corresponding PCT Application No. PCT/JP2017/0270117 dated Octoebr 17, 2017.

* cited by examiner

COMPRESSOR FOR REFRIGERATING MACHINE

CROSS-REFERENCE TO RELATED APPLICATIONS

This U.S. National stage application claims priority under 35 U.S.C. § 119(a) to Japanese Patent Application No. 2016-150615, filed in Japan on Jul. 29, 2016, the entire contents of which are hereby incorporated herein by reference.

TECHNICAL FIELD

The present invention relates to a compressor for a refrigerating machine.

BACKGROUND ART

Refrigerating machines are devices for controlling the target temperature, among which are included a wide range of machines such as freezers, refrigerators, air conditioners, ocean shipping containers, water heaters, and radiators. A refrigerating machine includes a refrigerant circuit in which a compressor for compressing the refrigerant is installed.

Japanese Patent Application Laid-open Publication No, 2002-303272 discloses a compressor used in an ocean shipping container. The casing of this compressor has protective coating applied thereto for the purpose of reducing corrosion attributable to the marine environment which involves adhesion of moisture, severe changes in temperature, and the like. The protective coating is formed by a technique called thermal spraying that sprays a surface of a base material with metallic material that has fluidity produced by melting or the like.

SUMMARY

The proportion of the metallic material that is attached to the base material by means of thermal spraying is typically a small ratio to the entire flowable material to be sprayed. Thermal spraying, therefore, wastes a lot of the metallic material, leading to an increase in the cost of the compressor.

An object of the present invention is to achieve cost reduction in a compressor for a refrigerating machine used in a harsh environment.

A compressor according to a first aspect of the present invention includes a casing and a metallic coating. The casing is configured to cover an internal space. The internal space includes a low-pressure space and a high-pressure space. The low-pressure space is configured to contain a low-pressure fluid. The high-pressure space is configured to contain a high-pressure fluid. The casing includes a low-pressure casing part covering the low-pressure space and a high-pressure casing part covering the high-pressure space. The metallic coating is formed at least on a part of an outer surface of the casing. The metallic coating includes a low-pressure part coating, a high-pressure part coating, and a welded part coating. The low-pressure part coating is formed in the low-pressure casing part. The high-pressure part coating is formed in the high-pressure casing part. The welded part coating is formed in a welded part formed in the casing. At least either an average thickness of the low-pressure part coating or an average thickness of the welded part coating is greater than an average thickness of the high-pressure part coating.

According to this configuration, a thin layer of the metallic coating is formed on the high-pressure casing part where adhered moisture is less likely to freeze. Accordingly, the material of the metallic coating can be reduced, and consequently cost reduction can be expected.

A compressor according to a second aspect of the present invention includes a casing and a metallic coating. The casing is configured to cover an internal space. The internal space includes a low-pressure space and a high-pressure space. The low-pressure space is configured to contain a low-pressure fluid. The high-pressure space is configured to contain a high-pressure fluid. The casing includes a low-pressure casing part covering the low-pressure space, a high-pressure casing part covering the high-pressure space, and a terminal guard installed on an outer surface of the casing. The metallic coating is formed at least on a part of the outer surface of the casing. The metallic coating includes a low-pressure part coating, a high-pressure part coating, a welded part coating, and a guard inner coating. The low-pressure part coating is formed in the low-pressure casing part. The high-pressure part coating is formed in the high-pressure casing part. The welded part coating is formed in a welded part formed in the casing. The guard inner coating is formed on an inner surface of the terminal guard. An average thickness of the guard inner coating is smaller than any of average thicknesses of the low-pressure part coating, the welded part coating, and the high-pressure part coating.

According to this configuration, a thin layer of the metallic coating is formed on the inner surface of the terminal guard that is extremely unlikely to be affected by the external environment. Thus, the desired effect of cost reduction is profound.

A compressor according to a third aspect of the present invention is the compressor according to the first aspect or the second aspect, wherein both the average thickness of the low-pressure part coating and the average thickness of the welded part coating are greater than the average thickness of the high-pressure part coating.

According to this configuration, thick layers of the metallic coating are formed on both the low-pressure casing part and the welded part. As a result, the occurrence of corrosion is further reduced at portions where corrosion is likely to occur due to damage of the metallic coating caused by freezing, transubstantiation of the base metal, and the like.

A compressor according to a fourth aspect of the present invention is the compressor according to any one of the first aspect to the third aspect, wherein the average thickness of the welded part coating is greater than the average thickness of the low-pressure part coating.

According to this configuration, an extremely thick layer of the metallic coating is formed on the welded part where corrosion is highly likely to occur due to transubstantiation of the base metal, or the like. As a result, the occurrence of corrosion is reduced more effectively.

A compressor according to a fifth aspect of the present invention is the compressor according to any one of the first aspect to the fourth aspect, wherein the metallic coating is a metal-sprayed coating that is in contact with the casing.

According to this configuration, the metal-sprayed coating is formed on the casing as the metallic coating. Therefore, portions of the casing that have complicated shapes are easily protected from moisture and the like.

A compressor according to a sixth aspect of the present invention is the compressor according to any one of the first aspect to the fifth aspect, wherein the casing is composed of a first metal. The metallic coating is composed of a second metal having an ionization tendency greater than that of the first metal.

According to this configuration, the metallic coating has an ionization tendency greater than that of the casing. In a case where moisture intrudes from holes or the like of the metallic coating and reaches the casing, the metallic coating tends to corrode prior to the casing. Therefore, the occurrence of corrosion of the casing is further reduced.

A compressor according to a seventh aspect of the present invention is the compressor according to any one of the first aspect to the sixth aspect, further including a compression mechanism that generates the high-pressure fluid by compressing the low-pressure fluid.

According to this configuration, the high-pressure fluid contained in the high-pressure space is discharged from the compression mechanism. Thus, the compressed high-pressure fluid can be utilized as a heat source for restraining freezing.

A compressor according to an eighth aspect of the present invention is the compressor according to any one of the first aspect to the seventh aspect, wherein the average thickness of the high-pressure part coating is 250 μm or more. The average thickness of the low-pressure part coating is 500 μm or more.

According to this configuration, values of the average thicknesses of the high-pressure part coating and the low-pressure part coating are defined. For example, the average thickness of the high-pressure part coating can be reduced to half the average thickness of the low-pressure part coating.

A freezing and refrigeration container unit for marine transportation according to a ninth aspect of the present invention includes a container, a utilization heat exchanger, a heat source heat exchanger, a first refrigerant flow path, a second refrigerant flow path, a decompression device, and a compressor. The container is configured to contain articles. The utilization heat exchanger is disposed inside the container. The heat source heat exchanger is disposed outside the container. The first refrigerant flow path and the second refrigerant flow path are each configured to move a refrigerant between the utilization heat exchanger and the heat source heat exchanger. The decompression device is provided in the first refrigerant flow path. The compressor is provided in the second refrigerant flow path. The compressor is the one described in any one of the first aspect to the eighth aspect.

According to this configuration, the compressor mounted in the freezing and refrigeration container unit for marine transportation can be expected to achieve cost reduction while reducing the occurrence of corrosion in the casing.

A manufacturing method according to a tenth aspect of the present invention manufactures the compressor according to any one of the first aspect to the eighth aspect. The manufacturing method includes a step of preparing the casing and a step of forming the metallic coating by thermally spraying the outer surface of the casing with a metal.

According to this method, the average thickness of the metallic coating is adjusted in the thermal spraying process. Therefore, an appropriate average thickness can easily be realized for each portion. As a result, cost reduction can he achieved with the anticorrosion structure of the compressor.

According to the compressor of the present invention, cost reduction can be expected.

According to the freezing and refrigeration container unit for marine transportation of the present invention, with the compressor mounted therein, achieving cost reduction can be expected while reducing the occurrence of corrosion in the casing.

According to the manufacturing method of the present invention, cost reduction can be achieved with the anticorrosion structure of the compressor.

DETAILED DESCRIPTION OF EMBODIMENT(S)

Embodiments of the compressor and the like according to the present invention are described hereinafter with reference to the drawings. Note that the specific configurations of the compressor and the like according to the present invention are not limited to the following embodiments and can be changed appropriately without departing from the gist of the present invention.

First Embodiment (1) Overall Configuration

Figure 1:
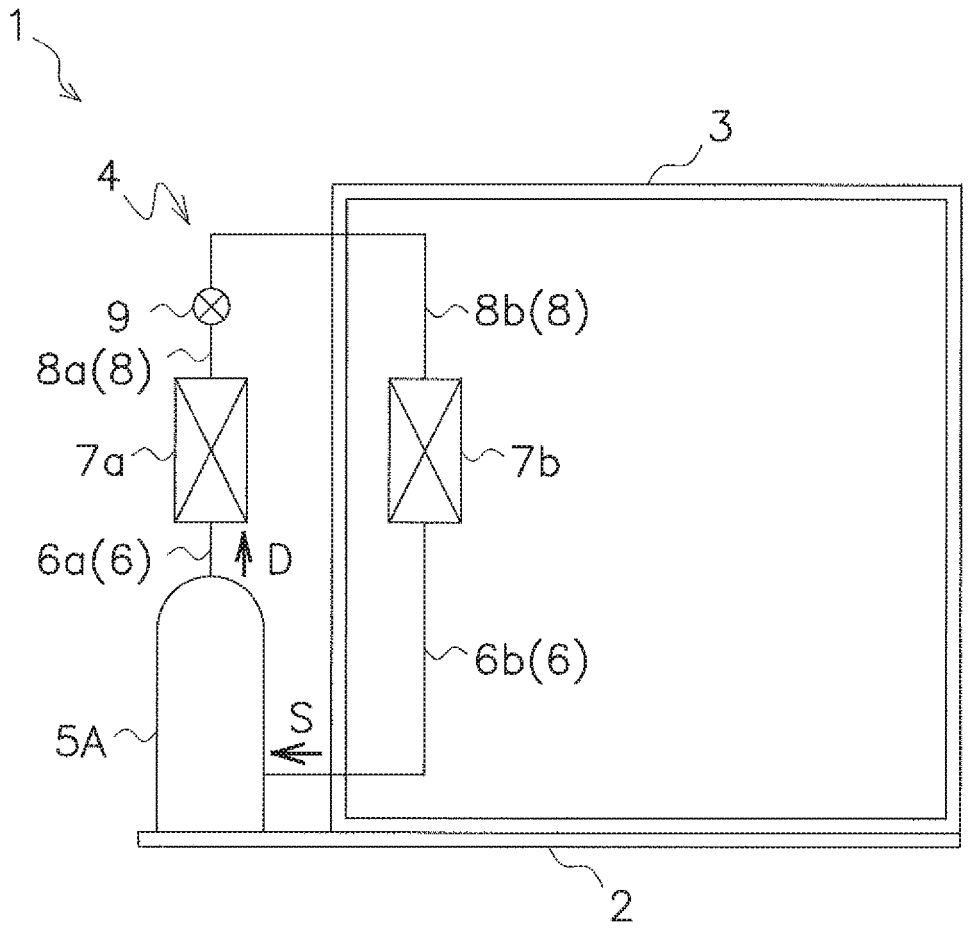
FIG. 1 is a schematic diagram showing a freezing and refrigeration container unit 1 for marine transportation according to a first embodiment of the present invention.

FIG. 1 shows the freezing and refrigeration container unit 1 for marine transportation having a compressor according to the first embodiment of the present invention. The freezing and refrigeration container unit 1 for marine transportation is placed on a ship and the like and used for transporting articles while freezing or refrigerating the articles.

The freezing and refrigeration container unit 1 for marine transportation includes a base plate 2, a container 3, and a refrigerant circuit 4. The container 3 is installed on the base plate 2 and configured to contain the articles. The refrigerant circuit 4 is configured to cool an internal space of the container 3.

(2) Detailed Configuration of Refrigerant Circuit 4

The refrigerant circuit 4 includes a heat source heat exchanger 7*a*, a utilization heat exchanger 7*b*, a first refrigerant flow path 8, a second refrigerant flow path 6, decompression device 9, and the compressor 5A.

(2-1) Heat Source Heat Exchanger 7*a*

The heat source heat exchanger 7*a* is disposed outside the container 3. The heat source heat exchanger 7*a* exchanges heat between the outside air and a refrigerant by functioning as a heat radiator for the refrigerant, typically a refrigerant condenser.

(2-2) Utilization Heat Exchanger 7*b*

The utilization heat exchanger 7*b* is disposed inside the container 3. The utilization heat exchanger 7*b* exchanges heat between the air inside the container 3 and the refrigerant by functioning as a heat absorber for the refrigerant, typically a refrigerant evaporator.

(2-3) First Refrigerant Flow Path 8

The first refrigerant flow path 8 is a flow path configured to move the refrigerant between the utilization heat exchanger 7*b* and the heat source heat exchanger 7*a*. The first refrigerant flow path 8 includes a second pipeline 8*a* and a third pipeline 8*h*.

(2-4) Second Refrigerant Flow Path 6

The second refrigerant flow path 6 is a flow path configured separately from the first refrigerant flow path 8 so as to move the refrigerant between the utilization heat exchanger 7*b* and the heat source heat exchanger 7*a*. The second refrigerant flow path 6 includes a first pipeline 6*a* and a fourth pipeline 6*b*.

(2-5) Decompression Device 9

The decompression device 9 is a device for decompressing the refrigerant and is composed of, for example, an expansion valve. The decompression device 9 is provided in the first refrigerant flow path 8. Specifically, the decompression device 9 is provided between the second pipeline 8*a* and the third pipeline 8*b*. The decompression device 9 may be located on the outside or inside of the container 3.

(2-6) Compressor 5A

The compressor 5A is a device for compressing a low-pressure gas refrigerant, which is a fluid, to generate a high-pressure gas refrigerant, which is also a fluid. The compressor 5A functions as a cold source in the refrigerant circuit 4. The compressor 5A is provided in the second refrigerant flow path 6. Specifically, the compressor 5A is provided between the first pipeline 6*a* and the fourth pipeline 6*b*. The compressor 5A may he located on the inside of the container 3, but in most cases the compressor 5A is located on the outside of the container 3.

(3) Basic Operations

In typical basic operations of the refrigerant circuit 4 described hereinafter, the heat source heat exchanger 7*a* functions as a refrigerant condenser, and the utilization heat exchanger 7*b* functions as a refrigerant evaporator. However, depending on the type of the refrigerant used or other conditions, the basic operations of the refrigerant circuit 4 are not limited to these.

As shown in FIG. 1, the refrigerant circulates in the directions of the arrow D and the arrow S in the refrigerant circuit 4. The compressor 5A discharges the high-pressure gas refrigerant in the direction of the arrow D. After proceeding through the first pipeline 6*a*, the high-pressure gas refrigerant reaches the heat source heat exchanger 7*a*, where the high-pressure gas refrigerant is condensed to a high-pressure liquid refrigerant. In this condensation process, the refrigerant dissipates heat to the outside air. After proceeding through the second pipeline 8*a*, the high-pressure liquid refrigerant reaches the decompression device 9, where the high-pressure liquid refrigerant is decompressed into a low-pressure gas-liquid two-phase refrigerant. After proceeding through the third pipeline 8*b*, the low-pressure gas-liquid two-phase refrigerant reaches the utilization heat exchanger 7*b*, where the low-pressure gas-liquid two-phase refrigerant is evaporated to a low-pressure gas refrigerant. In this evaporation process, the refrigerant provides cold heat to the air inside the container 3, thereby freezing or refrigerating the articles contained in the container 3. After proceeding through the fourth pipeline 6*b*, the low-pressure gas refrigerant is suctioned into the compressor 5A along the arrow S.

(4) Detailed Configuration of Compressor 5A

Figure 2:
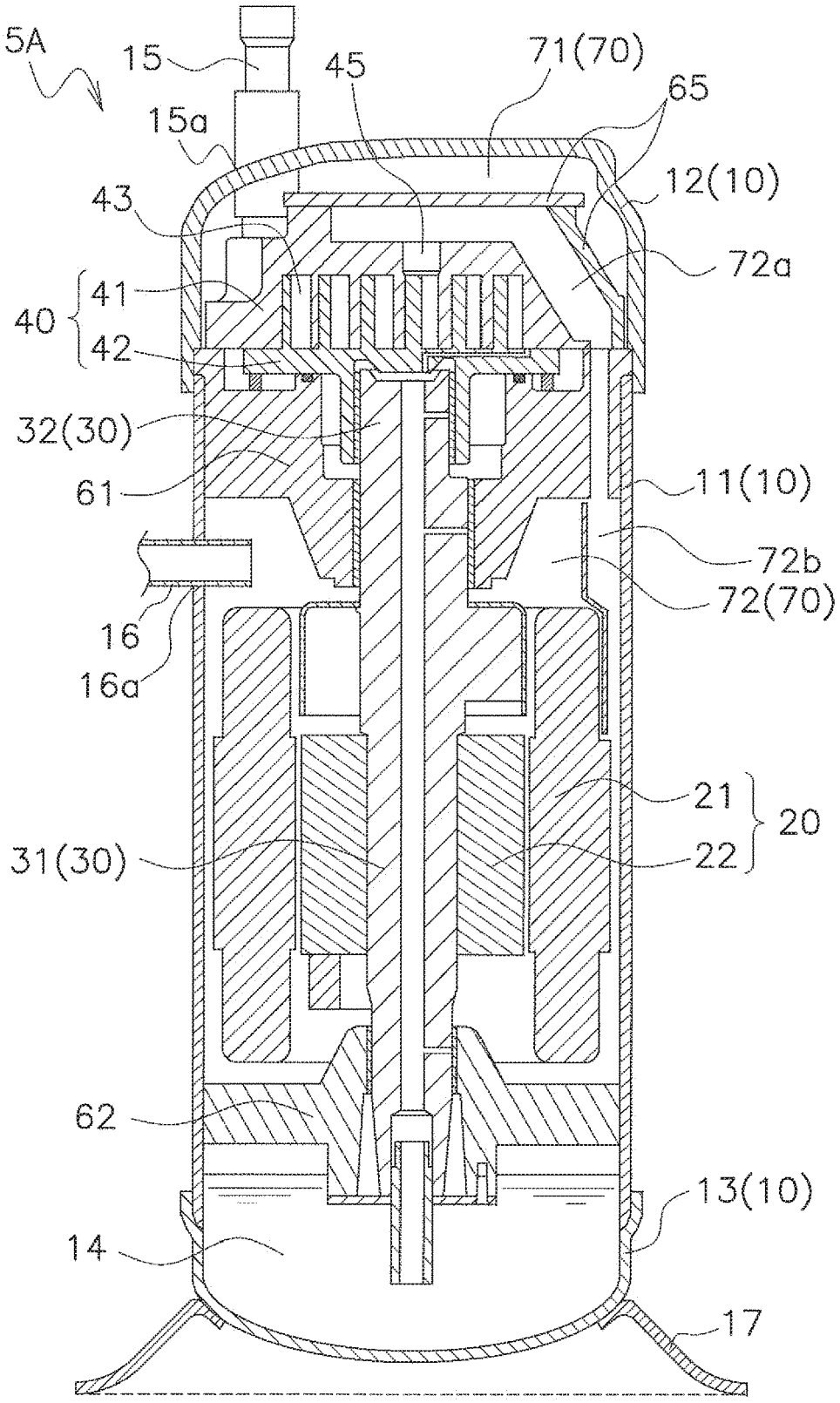
FIG. 2 is a cross-sectional view of a compressor 5A according to the first embodiment of the present invention.

FIG. 2 is a cross-sectional view of the compressor 5A according to the first embodiment of the present invention. The compressor 5A is a so-called high-pressure dome type scroll compressor. The compressor 5A includes the casing 10, a motor 20, a crankshaft 30, a compression mechanism 40, an upper bearing holding member 61, and a lower bearing holding member 62.

(4-1) Casing 10

The casing 10 is configured to contain, in an internal space 70 thereof, the motor 20, the crankshaft 30, the compression mechanism 40, the upper bearing holding member 61, and the lower bearing holding member 62. The casing 10 includes a casing body part 11, a casing upper part 12, and a casing lower part 13, which are welded together airtight. The casing 10 is strong enough to withstand the pressure of the refrigerant filling the internal space 70.

The casing upper part 12 is provided with a suction port 15*a*, and a suction pipe 15 for suctioning the refrigerant is inserted into the suction port 15*a* and fixed airtight thereto by welding. The casing body part 11 is provided with a discharge port 16*a*, and a discharge pipe 16 for discharging the refrigerant is inserted into the discharge port 16*a* and fixed airtight thereto by welding. An oil reservoir 14 for storing a refrigeration oil is provided in the lower part of the internal space 70 of the casing 10. A support part 17 for supporting the casing 10 upright is welded to the casing lower part 13.

The internal space 70 of the casing is divided into a low-pressure space 71 and a high-pressure space 72 by a partition member 65 and other parts. The low-pressure space 71 is configured to be filled with the low-pressure gas refrigerant. The high-pressure space 72 is configured to be filled with the high-pressure gas refrigerant. The high-pressure space 72 has a volume that is greater than that of the low-pressure space 71.

(4-2) Motor 20

The motor 20 receives a supply of electricity to generate power. The motor 20 has a stator 21 and a rotor 22. The stator 21 is fixed to the casing 10 and has a coil, not shown, for generating a magnetic field. The rotor 22 is configured to be rotatable with respect to the stator 21 and has a permanent magnet, not shown, for magnetically interacting with the coil. The motor 20 is disposed in the high-pressure space 72.

(4-3) Crankshaft 30

The crankshaft 30 transmits the power generated by the motor 20. The crankshaft 30 includes a concentric part 31 and an eccentric part 32. The concentric part 31 has a shape concentric with the rotation axis of the rotor 22 and is fixed together with the rotor 22. The eccentric part 32 is eccentric with respect to the rotation axis of the rotor 22. When the concentric part 31 rotates together with the rotor 22, the eccentric part 32 moves in a circle.

(4-4) Compression Mechanism 40

The compression mechanism 40 is a mechanism for compressing the low-pressure gas refrigerant to generate the high-pressure gas refrigerant. The compression mechanism 40 is driven by the power transmitted by the crankshaft 30. The compression mechanism 40 includes a fixed scroll 41 and a movable scroll 42. The fixed scroll 41 is fixed directly or indirectly to the casing 10. For example, the fixed scroll 41 is fixed indirectly to the casing body part 11 via the upper bearing holding member 61 described hereinafter. The movable scroll 42 is configured to be able to revolve with respect to the fixed scroll 41. The eccentric part 32 of the crankshaft 30 is fitted to the movable scroll 42 together with a bearing. As the eccentric part 32 moves in a circle, the movable scroll 42 revolves with power.

The fixed scroll 41 and lovable scroll 42 each have an end plate and a spiral wrap standing upright on the end plate. Several spaces surrounded by the end plates and the wraps of the fixed scroll 41 and the movable scroll 42 are compression chambers 43. When the movable scroll 42 revolves, one compression chamber 43 gradually reduces the volume thereof while moving from the peripheral portion to the central portion. In this process, the low-pressure gas refrigerant contained in the compression chamber 43 is compressed into the high-pressure gas refrigerant. The high-pressure gas refrigerant is discharged from a discharge port 45 provided in the fixed scroll 41 to a chamber 72*a* located outside the compression mechanism 40, and then passes through a high-pressure passage 72*b*. The chamber 72*a* and the high-pressure passage 72*b* each constitute a part of the high-pressure space 72. The high-pressure gas refrigerant in the high-pressure space 72 is eventually discharged from the discharge pipe 16 to the outside of the compressor 5A.

The compression mechanism 40 as a whole may function to divide the low-pressure space 71 and the high-pressure space 72 from each other in cooperation with the partition member 65.

(4-5) Upper Bearing Holding Member 61

The upper bearing holding member 61 holds a bearing. The upper bearing holding member 61 rotatably supports the upper side of the concentric part 31 of the crankshaft 30 via the bearing. The upper bearing holding member 61 is fixed to an upper part of the casing body part 11. The upper bearing holding member 61 may function to divide the low-pressure space 71 and the high-pressure space 72 from each other in cooperation with the partition member 65.

(4-6) Lower Bearing Holding Member 62

The lower bearing holding member 62 holds a bearing. The lower bearing holding member 62 rotatably supports the lower side of the concentric part 31 of the crankshaft 30 via the bearing. The lower bearing holding member 62 is fixed to a lower part of the casing body part 11.

(5) Detailed Structure of Casing 10

Figure 3:
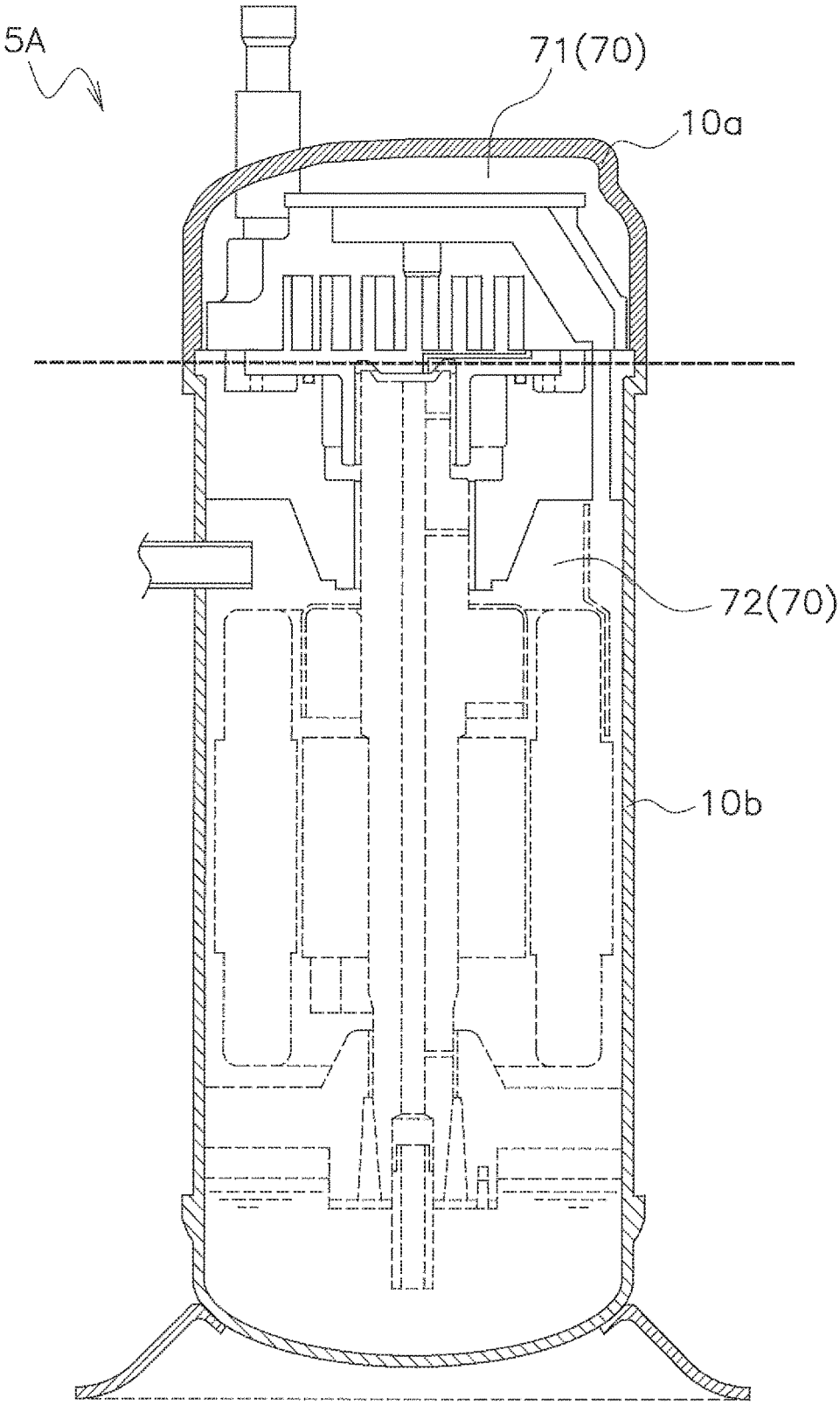
FIG. 3 is a cross-sectional view of the compressor 5A according to the first embodiment of the present invention.

FIG. 3 is a diagram for explaining the high-pressure dome type scroll structure of the compressor 5A. The casing 10, which is an assembly of the casing body part 11, the casing upper part 12, and the casing lower part 13, includes two regions, a low-pressure casing part 10*a* and a high-pressure casing part 10*b*, from a functional viewpoint. The low-pressure casing part 10*a* is a region covering the low-pressure space 71. The high-pressure casing part 10*b* is a region covering the high-pressure space 72. The high-pressure casing part 10*b* makes up a dominant proportion to the surface area of the casing 10.

Figure 4:
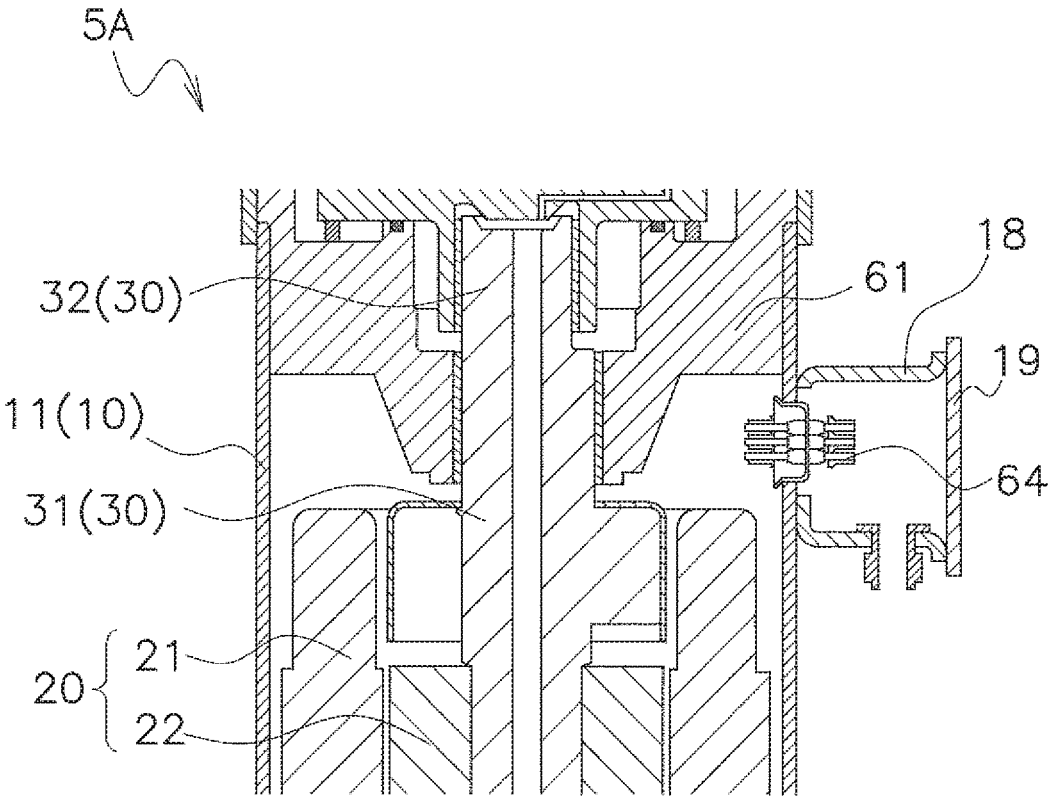
FIG. 4 is a cross-sectional view of the compressor 5A according to the first embodiment of the present invention.

FIG. 4 is another cross-sectional view of the compressor 5A, viewed along a line different from that of the sectional view shown in FIG. 2. A terminal 64 for supplying electricity to the motor 20 is buried in the casing body part 11. A terminal guard 18 is installed in the casing body part 11. A terminal cover 19 is attached to the terminal guard 18. The terminal guard 18 and the terminal cover 19 protect the terminal 64 from the external environment by surrounding the terminal 64.

Figure 5:
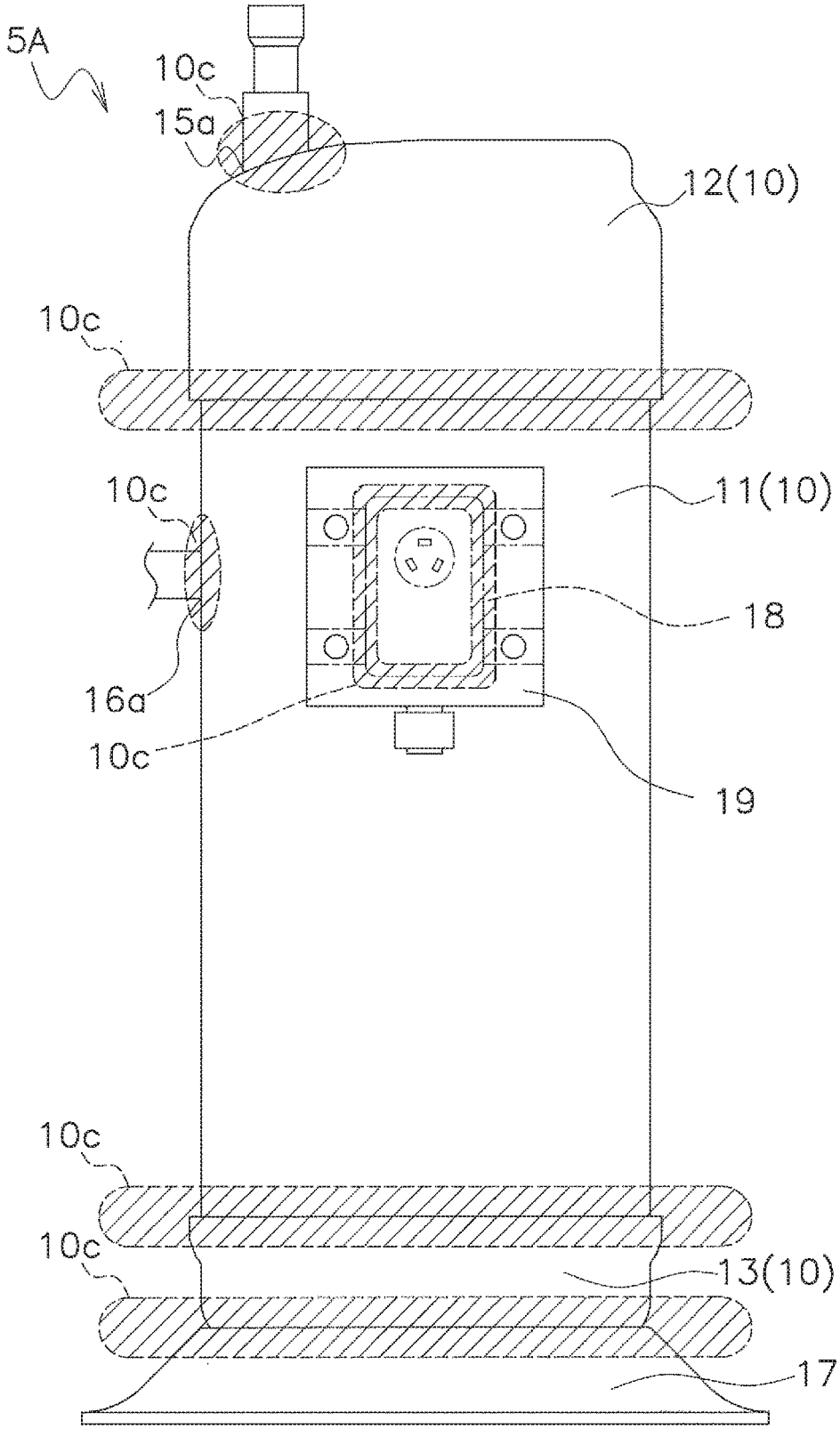
FIG. 5 is an external view of the compressor 5A according to the first embodiment of the present invention.

FIG. 5 is an external view of the compressor 5A, showing welded parts 10*c* formed in the casing 10 and the like. The welded parts 10*c* are found in, for example, the portion of the suction port 15*a*, the portion of the discharge port 16*a*, the joint portions between the casing body part 11 and the casing upper part 12, the casing lower part 13, and the terminal guard 18, the joint portion between the casing lower part 13 and the support part 17, and the like.

(6) Protective Coating in Casing 10 etc.

For the purpose of protecting the compressor 5A, protective coating is applied to at least part of the casing 10, the suction pipe 15, the discharge pipe 16, the support part 17, the terminal guard 18, the terminal cover 19, and other parts (collectively referred to as "base metal," hereinafter). The protective coating is provided in order to reduce corrosion of the base metal. The protective coating reduces adhesion of moisture and the like to the base metal, which is attributable to the marine environment.

(6-1) Materials

While the base metal is composed of a first metal, the protective coating is a metallic coating composed of, for example, a second metal different from the first metal. It is preferred that the second metal be a so-called less-noble metal having an ionization tendency greater than that of the first metal. The first metal is, for example, iron. The second metal is, for example, aluminum, magnesium, zinc, or an alloy containing any of these metals.

Figure 6:
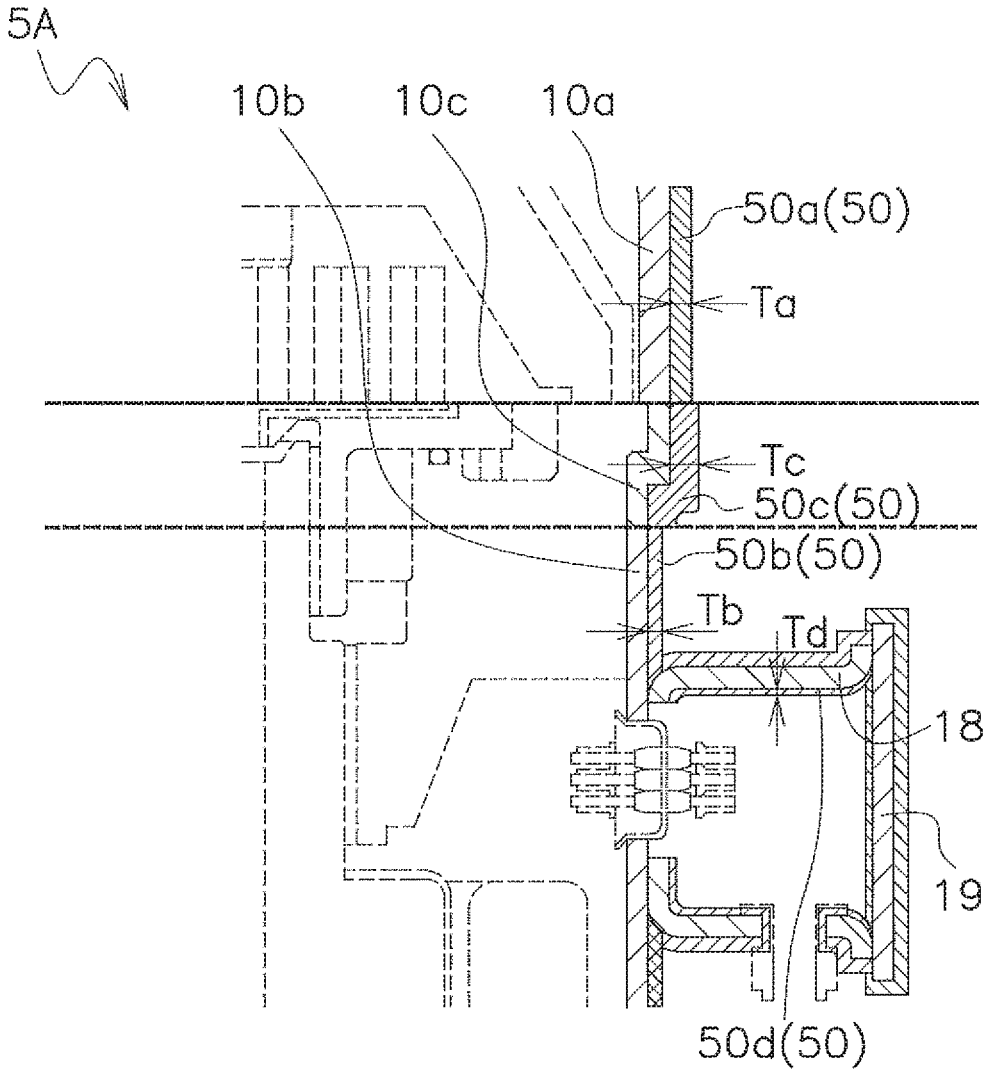
FIG. 6 is a schematic diagram of a casing 10 of the compressor 5A according to the first embodiment of the present invention.

Moreover, the metallic coating used as the protective coating may be made of a material obtained by mixing ceramics with the second metal, (6-2) Thicknesses FIG. 6 is a schematic diagram showing in an exaggerated manner a metallic coating 50 provided on the base metal such as the casing 10. The metallic coating 50 is formed in such a manner as to come into contact with the base metal. The thickness of the metallic coating 50 varies depending on where the metallic coating 50 is formed. A low-pressure part coating 50*a* is a metallic coating 50 formed in the low-pressure casing part 10*a*, and has an average thickness Ta. A high-pressure part coating 50*b* is a metallic coating 50 formed in the high-pressure casing part 10*b*, and has an average thickness Tb. A welded part coating 50*c* is a metallic coating 50 formed in each of the welded parts 10*c*, and has an average thickness Tc. A guard inner coating 50*d* is a metallic coating 50 formed on an inner surface of the terminal guard 18, and has an average thickness Td.

The welded parts 10*c* are where the base metal is extremely likely to corrode due to the fact that the base metal transubstantiates and becomes non-uniform as a result of welding. Since the low-temperature, low-pressure gas refrigerant comes into contact with the low-pressure casing part 10*a*, moisture generated by dew condensation tends to adhere to the low-pressure casing part 10*a*. Moreover, the moisture adhered to the low-pressure casing part 10*a* tends to freeze. As the compressor 5A is repeatedly operated and stopped, freezing and melting of the moisture occur alternately in the low-pressure casing part 10*a*, and the metallic coating 50 is liable to be damaged by stress caused by such freezing and melting. For this reason, the possibility of corrosion of the base metal at the low-pressure casing part 10*a* is relatively high. Since the high-temperature, high-pressure gas refrigerant comes into contact with the high-pressure casing part 10*b*, dew condensation is less likely to occur in the high-pressure casing part 10*b*. Moreover, moisture attached to the high-pressure casing part 10*b* is less likely to freeze. For this reason, the possibility of corrosion of the base metal at the high-pressure casing part 10*b* is relatively low. Because the inner surface of the terminal guard 18 is isolated from the external environment, the possibility of corrosion of the base metal therein is significantly low.

In view of these conditions described above, the thickness of the metallic coating 50 at each part is adjusted. At least either the average thickness Ta of the low-pressure part coating 50*a* or the average thickness Tc of the welded part coating 50*c* is greater than the average thickness Tb of the high-pressure part coating Sob. Preferably, both the average thickness Ta of the low-pressure part coating 50*a* and the average thickness Tc of the welded part coating 50*c* are greater than the average thickness Tb of the high-pressure part coating 50*b*. The average thickness Td of the guard inner coating 50*d* is smaller than any of the average thickness Ta of the low-pressure part coating 50*a*, the average thickness Tb of the high-pressure part coating 50*b*, and the average thickness Tc of the welded part coating 50*c*. It is preferred that the average thickness Tc of the welded part coating 50*c* be greater than the average thickness Ta of the low-pressure part coating 50*a*. The average thickness Tb of the high-pressure part coating 50*b* is, for example, 250 μm or more, and the average thickness Ta of the low-pressure part coating 50*a* is, for example, 500 μm or more.

(6-3) Formation Methods

The metallic coating 50 can he formed by various methods such as thermal spraying, vacuum deposition, sputtering, plating, and pasting of rolled metal foil. When a metal-sprayed coating formed by thermal spraying is adopted as the metallic coating 50, the average thickness of the metallic coating 50 can easily he changed depending on the part of the base metal. The metal-sprayed coating, the average thickness of which is controlled in accordance with the likeliness of corrosion of the abovementioned part of the base plate, has a structure and ability to reduce corrosion of this part of the base metal over a long period of time. In addition, although the metal-sprayed coating sometimes has the properties of a porous material, the average thickness of the metal-sprayed coating can be controlled and made thick to the extent that performance of the protective coating is not impaired by such properties. Furthermore, since the position, angle, and moving speed of the spray head of a thermal sprayer can he adjusted relatively freely, the metal-sprayed coating can easily be formed even on portions on the base metal that have complicated shapes.

(6-4) Method for Manufacturing Compressor 5A

An example of the method for manufacturing the compressor 5A having a metal-sprayed coating as the metallic coating 50 is now described hereinafter.

(6-4-1) Preparation

The compressor 5A, which does not yet have the protective coating formed thereon, is prepared. Basic assembly of the compressor 5A is completed. Various parts and the refrigeration oil are contained in the casing 10. An anti-rust oil is applied to a surface of the base metal such as the casing 10, in order to prevent rust from forming during the storage life.

(6-4-2) Degreasing

For the purpose of achieving stronger adhesion of the metallic coating 50 to be formed to the base metal, a degreasing process for removing the anti-rust oil from the base metal is performed.

(6-4-3) Masking

Masking is performed on portions where the metallic coating 50 is preferably not formed. The portions to be masked include, for example, the terminal 64, bolt holes formed in the base metal, and the like, (6-4-4) Roughening For the purpose of achieving stronger adhesion of the metallic coating 50, a blasting process is performed to make the surface of the base metal rough. As a result of the blasting process, oxide films, scales, and other deposits on the surface of the base metal are removed. It is preferred that the shape of the surface of the base metal after the blasting process be sharp. For this reason, as a shot blasting material used in the blasting process, sharp particles are preferred over spherical particles. It is preferred that the shot blasting material be alumina having hardness.

A process for applying a rough surface forming agent to the surface of the base metal may be performed in place of the blasting process.

(6-4-5) Heating

The base metal is heated in order to evaporate and remove the moisture and the like on the surface of the base metal. As a result, adhesion of the metallic coating 50 to the base metal is further improved. The temperature of the surface of the base metal preferably does not exceed, for example, 150° C. Accordingly, damage to various parts and deterioration of the refrigeration oil can be restrained.

(6-4-6) Thermal Spraying

A thermal spraying process for spraying the surface of the base metal with a flowable material is performed. It is preferred that the thermal spraying process be performed within four hours after the blasting process. Otherwise, the adhesion between the metallic coating 50 and the base metal drops due to a decrease in surface activity, adhesion of moisture, and the like.

As described above, a mixture of the second metal and ceramics may he used as the flowable material instead of using the second metal. Alternatively, a ceramics-sprayed coating may be formed on the metal-sprayed coating composed of the second metal, and then a plurality of layers of protective coating may be formed thereon. Depending on the type of the flowable material, an appropriate thermal spraying method is selected from among flame spraying, arc spraying, plasma spraying, and the like.

The thickness of the metal-sprayed coating to be formed is controlled by adjusting the spraying time, the angle and moving speed of the spray head of the thermal sprayer, and other conditions. In a case where an edge is present in the base metal, the thickness of the metal-sprayed coating at the portion of the edge tends to be smaller than an intended thickness. For this reason, it is preferred that the base metal be chamfered prior to the execution of the thermal spraying process.

(6-4-7) Sealing

In order to reliably reduce corrosion of the base metal, a sealing process for closing holes present in the formed metal-sprayed coating is performed. In the sealing process, a sealing agent is applied to the metal-sprayed coating with a brush. Alternatively, the sealing agent may be sprayed onto the metal-sprayed coating. Alternatively, the base metal having the metal-sprayed coating may be immersed in a tank of sealing agent.

Examples of the sealing agent include, for example, silicon resin, acrylic resin, epoxy resin, urethane resin, and fluorine resin. The sealing agent may contain metallic flake. In this case, a labyrinth seal is formed in the holes of the metal-sprayed coating, reducing the moisture permeability of the metal-sprayed coating.

The sealing process is performed within twelve hours at most, or preferably five hours, after the thermal spraying process. Otherwise, moisture adhesion and the like may occur, preventing the sealing agent from penetrating easily.

As with the thermal spraying process, it is preferred that the base metal be heated in advance in performing the sealing process.

(6-4-8) Painting

In order to further improve anticorrosion performance or to improve the appearance of the compressor 5A, painting may he performed.

(7) Features (7-1)

At least either the average thickness Ta of the low-pressure part coating 50*a* or the average thickness Tc of the welded part coating 50*c* is greater than the average thickness Tb of the high-pressure part coating 50*b*. In other words, a thin layer of the metallic coating 50 is formed on the high-pressure casing part 10*b* where adhered moisture is less likely to freeze. Accordingly, the material of the metallic coating 50 can be reduced, and consequently cost reduction can be expected.

(7-2)

The average thickness Td of the guard inner coating 50*d* is smaller than any of the average thickness Ta of the low-pressure part coating 50*a*, the average thickness Tc of the welded part coating 50*c*, and the average thickness Tb of the high-pressure part coating Sob. In other words, an extremely thin layer of the metallic coating 50 is formed on the inner surface of the terminal guard 18 that is extremely unlikely to be affected by the external environment. Thus, the desired effect of cost reduction is profound.

(7-3)

Both the average thickness Ta of the low-pressure part coating 50*a* and the average thickness Tc of the welded part coating 50*c* can be made greater than the average thickness Tb of the high-pressure part coating 50*b*. In this case, thick layers of the metallic coating 50 are formed on the low-pressure casing part 10*a* and the welded parts 10*c*. As a result, the occurrence of corrosion is further reduced at portions where corrosion is likely to occur due to damage of the metallic coating caused by freezing, transubstantiation of the base metal, and the like.

(7-4)

The average thickness Tc of the welded part coating 50*c* can be made greater than the average thickness Ta of the low-pressure part coating 50*a*. In this case, an extremely thick layer of the metallic coating 50 is formed on each welded part 10*c* where corrosion is highly likely to occur due to transubstantiation of the base metal, or the like. As a result, the occurrence of corrosion is reduced more effectively.

(7-5)

A metal-sprayed coating is formed on the casing 10 as the metallic coating 50. Therefore, portions of the casing 10 that have complicated shapes are easily protected from moisture and the like.

(7-6)

The casing 10 is composed of the first metal, and the metallic coating 50 is composed of the second metal having an ionization tendency greater than that of the first metal. In a case where moisture intrudes from the holes or the like of the metallic coating 50 and reaches the casing 10, the metallic coating 50 tends to corrode prior to the casing 10. In other words, the metallic coating 50 has a function of sacrificial protection. Therefore, the occurrence of corrosion of the casing 10 is further reduced.

(7-7)

The compressor 5A includes the compression mechanism 40 that generates the high-pressure fluid by compressing the low-pressure fluid. The high-pressure fluid contained in the high-pressure space 72 is discharged from the compression mechanism 40. Thus, the compressed high-pressure fluid can be utilized as a heat source for preventing freezing.

(7-8)

The average thickness Tb of the high-pressure part coating 50*b* can be set at 250 μm or more, and the average thickness Ta of the low-pressure part coating 50*a* can be set at 500 μm or more. In this case, for example, the average thickness Tb of the high-pressure part coating 50*b* can he reduced to half the average thickness Ta of the low-pressure part coating 50*a*.

(7-9)

The compressor 5A mounted in the freezing and refrigeration container unit 1 for marine transportation can be expected to achieve cost reduction while reducing the occurrence of corrosion in the casing 10.

(7-10)

The average thickness of the metallic coating 50 is adjusted in the thermal spraying process. Therefore, an appropriate average thickness can easily be realized for each portion.

Second Embodiment (1) Structure

Figure 7:
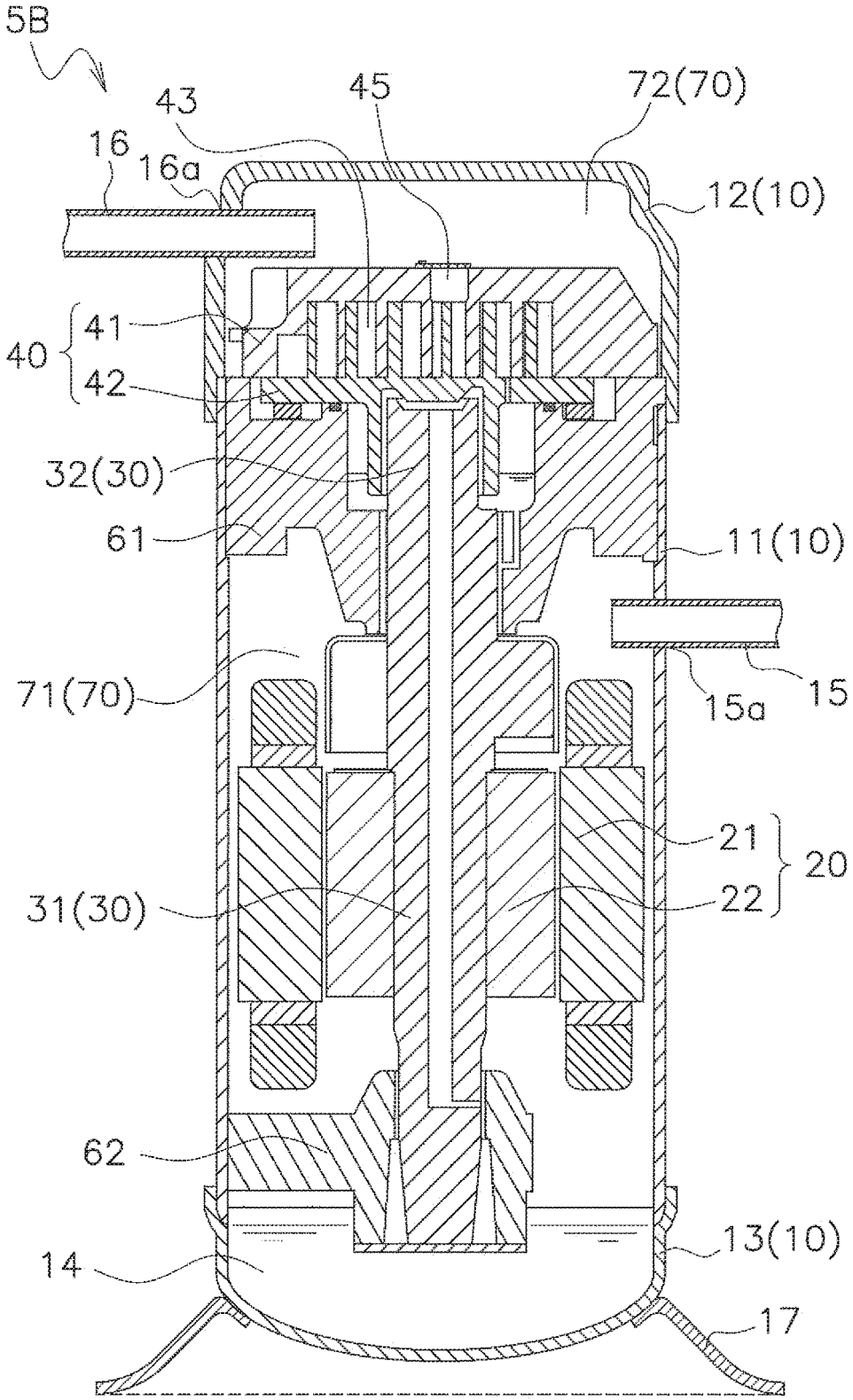
FIG. 7 is a cross-sectional view of a compressor 5B according to a second embodiment of the present invention.

FIG. 7 is a cross-sectional view of the compressor 5B according to the second embodiment of the present invention. The compressor 5B is a so-called low-pressure dome type scroll compressor. As shown in FIG. 7, same reference numerals are used on the same parts as those of the compressor 5A according to the first embodiment. In place of the compressor 5A according to the first embodiment, the compressor 5B according to the second embodiment can be mounted in the freezing and refrigeration container unit 1 for marine transportation shown in FIG. 1.

The internal space 70 of the casing is divided into the low-pressure space 71 and the high-pressure space 72 by the upper bearing holding member 61 or other parts. The low-pressure space 71 has a volume that is greater than that of the high-pressure space 72.

Figure 8:
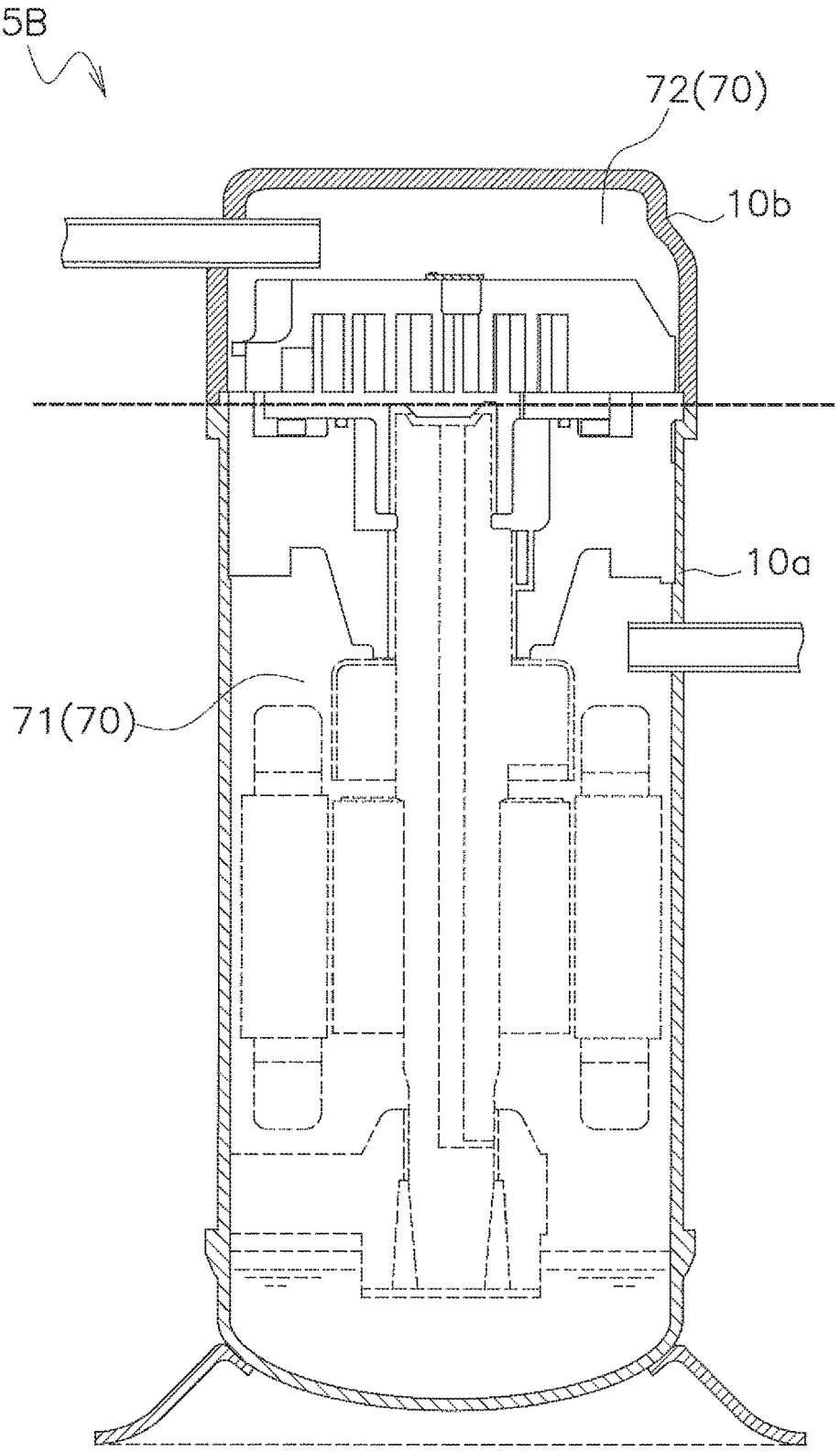
FIG. 8 is a cross-sectional view of the compressor 5B according to the second embodiment of the present invention.

FIG. 8 is a diagram for explaining the low-pressure dome type scroll structure of the compressor 5B. The casing 10 includes two regions, the low-pressure casing part 10*a* and the high-pressure casing part 10*b*, from a functional viewpoint. The compressor 5B is different from the compressor 5A according to the first embodiment in that the low-pressure casing part 10*a* makes up a dominant proportion to the surface area of the casing 10.

Figure 9:
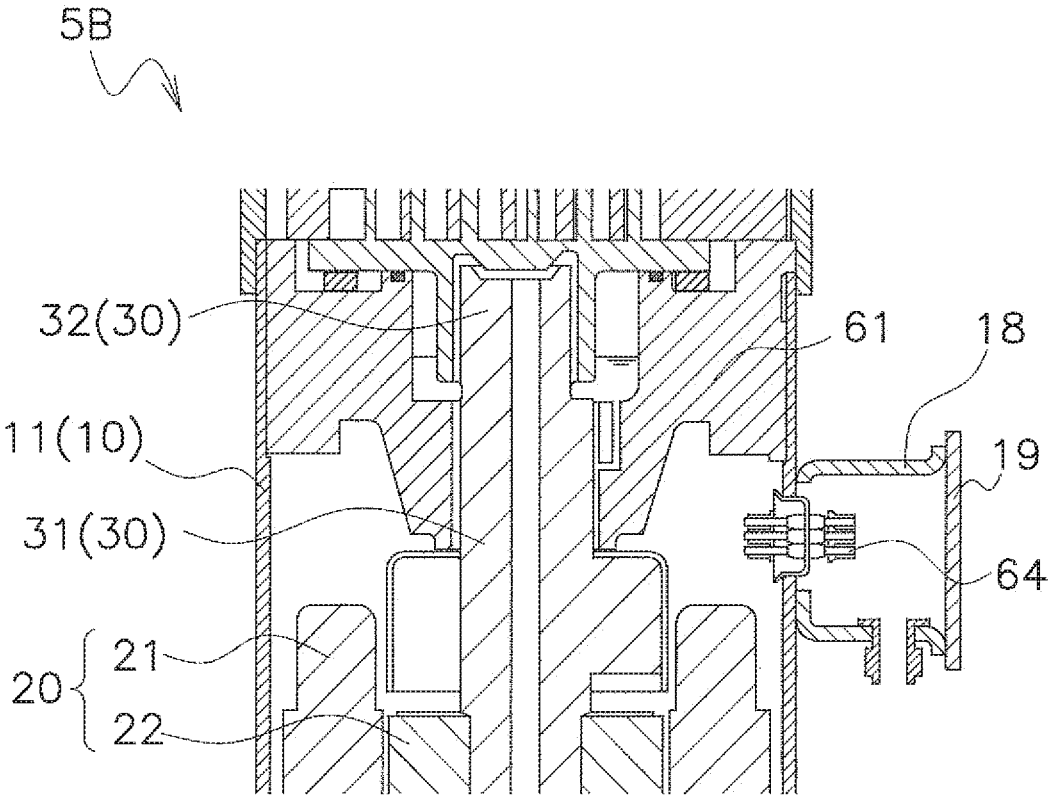
FIG. 9 is a cross-sectional view of the compressor 5B according to the second embodiment of the present invention.

FIG. 9 is another cross-sectional view of the compressor 5B, viewed along a line different from that of the sectional view shown in FIG. 7. The compressor 5B, too, includes the terminal guard 18 and the terminal cover 19 that are configured to surround the terminal 64.

Figure 10:
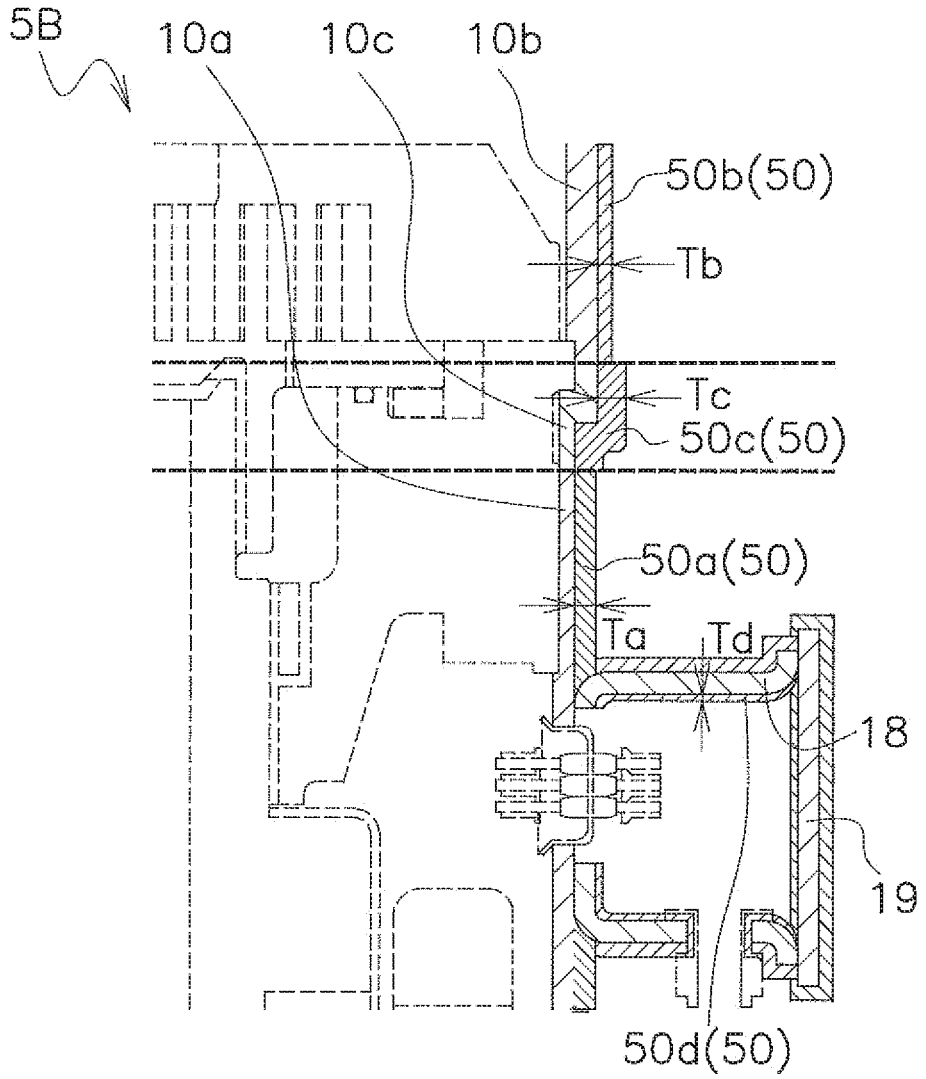
FIG. 10 is a schematic diagram of a casing 10 of the compressor 5B according to the second embodiment of the present invention.

FIG. 10 is a schematic diagram showing the metallic coating 50 provided as the protective coating on the base metal such as the casing 10. The concepts of the material and thickness of the metallic coating 50, as well as a method for forming the metallic coating 50, are the same as those of the first embodiment.

(2) Features

The compressor 5B according to the second embodiment can achieve the same effects as those of the compressor 5A according to the first embodiment.

What is claimed is:

1. A compressor, comprising:

a casing; and a metallic coating formed on at least a portion of an outer surface of the casing, the casing being configured to cover an internal space, the internal space including a low-pressure space configured to contain a low-pressure fluid, the internal space including a high-pressure space configured to contain a high-pressure fluid, the casing having a low-pressure casing part covering the low-pressure space, the casing having a high-pressure casing part covering the high-pressure space, the metallic coating including a low-pressure part coating formed on an outside of the low-pressure casing part, a high-pressure part coating formed on an outside of the high-pressure casing part, and a welded part coating formed on an outside of a welded part, the welded part being formed in the casing, at least either an average thickness of the low-pressure part coating or an average thickness of the welded part coating being greater than an average thickness of the high-pressure part coating, the low-pressure fluid coming into contact with the low-pressure casing part and the high-pressure fluid coming into contact with the high-pressure casing part during operation of the compressor, and the high-pressure fluid having a higher temperature than the low-pressure fluid.

2. The compressor according to claim 1, wherein both the average thickness of the low-pressure part coating and the average thickness of the welded part coating are greater than the average thickness of the high-pressure part coating.

3. The compressor according to claim 1, wherein the average thickness of the welded part coating is greater than the average thickness of the low-pressure part coating.

4. The compressor according to claim 1, wherein the metallic coating is a metal-sprayed coating that is in contact with the casing.

5. The compressor according to claim 1, wherein the casing includes a first metal, and the metallic coating includes a second metal having an ionization tendency greater than the first metal.

6. The compressor according to claim 1, further comprising:

a compression mechanism including a compression chamber.

7. The compressor according to claim 1, wherein the average thickness of the high-pressure part coating is at least 250 μm, and the average thickness of the low-pressure part coating is at least 500 μm.

8. A freezing and refrigeration container unit for marine transportation, the freezing and refrigeration container unit comprising:

the compressor according to claim 1;

a container configured to contain articles;

a utilization heat exchanger disposed inside the container;

a heat source heat exchanger disposed outside the container;

a first refrigerant flow path and a second refrigerant flow path that are each configured to move a refrigerant between the utilization heat exchanger and the heat source heat exchanger, the compressor being provided in the second refrigerant flow path; and a decompression device provided in the first refrigerant flow path.

9. A method for manufacturing the compressor according to claim 1, the method comprising:

preparing the casing; and forming the metallic coating by thermally spraying the outer surface of the casing with a metal.

10. The compressor according to claim 1, wherein the welded part is disposed between the low-pressure casing part and the high-pressure casing part, the average thickness of the low-pressure part coating is a larger than the average thickness of the high-pressure part coating, and average thickness of the welded part coating is larger than the average thickness of the low-pressure part coating.

11. A compressor, comprising:

a casing; and a metallic coating formed on at least a portion of an outer surface of the casing, the casing being configured to cover an internal space, the internal space including a low-pressure space configured to contain a low-pressure fluid, the internal space including a high-pressure space configured to contain a high-pressure fluid, the casing having a low-pressure casing part covering the low-pressure space, the casing having a high-pressure casing part covering the high-pressure space, the casing having a terminal guard installed on an outer surface, the metallic coating including a low-pressure part coating formed on an outside of the low-pressure casing part, a high-pressure part coating formed on an outside of the high-pressure casing part, a welded part coating formed on an outside of a welded part formed in the casing, and a guard inner coating formed on an inner surface of the terminal guard, the guard inner coating having an average thickness that is smaller than any of an average thickness of the low-pressure part coating, an average thickness of the welded part coating, and an average thickness of the high-pressure part coating, the low-pressure fluid coming into contact with the low-pressure casing part and the high-pressure fluid coming into contact with the high-pressure casing part during operation of the compressor, and the high-pressure fluid having a higher temperature than the low-pressure fluid.

12. The compressor according to claim 11, wherein both the average thickness of the low-pressure part coating and the average thickness of the welded part coating are greater than the average thickness of the high-pressure part coating.

13. The compressor according to claim 11, wherein the average thickness of the welded part coating is greater than the average thickness of the low-pressure part coating.

14. The compressor according to claim 11, wherein the metallic coating is a metal-sprayed coating that is in contact with the casing.

15. The compressor according to claim 11, wherein the casing includes a first metal, and the metallic coating includes a second metal having an ionization tendency greater than the first metal.

16. The compressor according to claim 11, further comprising:

a compression mechanism including a compression chamber.

17. The compressor according to claim 11, wherein the average thickness of the high-pressure part coating is at least 250 μm, and the average thickness of the low-pressure part coating is at least 500 μm.

18. A freezing and refrigeration container unit for marine transportation, the freezing and refrigeration container unit comprising:

the compressor according to claim 11;

a container configured to contain articles;

a utilization heat exchanger disposed inside the container;

a heat source heat exchanger disposed outside the container;

a first refrigerant flow path and a second refrigerant flow path that are each configured to move a refrigerant between the utilization heat exchanger and the heat source heat exchanger, the compressor being provided in the second refrigerant flow path; and a decompression device provided in the first refrigerant flow path.

19. A method for manufacturing the compressor according to claim 11, the method comprising:

preparing the casing; and forming the metallic coating by thermally spraying the outer surface of the casing with a metal.

20. The compressor according to claim 11, wherein the low-pressure casing part includes a suction port through which a suction pipe is inserted, the high-pressure casing part includes a discharge port through which a discharge pipe is inserted, and the welded part includes an area surrounding the suction port and an area surrounding the discharge port.

* * * * *